US008857806B2

(12) United States Patent
Goszka et al.

(10) Patent No.: US 8,857,806 B2
(45) Date of Patent: Oct. 14, 2014

(54) APPARATUS AND METHOD FOR ORIENTING PRODUCTS FOR APPLYING INDICIA DURING TRANSPORT

(75) Inventors: Timothy Goszka, Emmaus, PA (US); John Messenger, Allentown, PA (US)

(73) Assignee: Muller Martini Corp., Hauppauge, NY (US)

( * ) Notice: Subject to any disclaimer, the term of this patent is extended or adjusted under 35 U.S.C. 154(b) by 1126 days.

(21) Appl. No.: 12/764,365

(22) Filed: Apr. 21, 2010

(65) Prior Publication Data

US 2011/0259710 A1 Oct. 27, 2011

(51) Int. Cl.
*B65H 37/06* (2006.01)
*B65H 29/00* (2006.01)

(52) U.S. Cl.
CPC ..... *B65H 29/003* (2013.01); *B65H 2301/5111* (2013.01); *B65H 2701/132* (2013.01); *B65H 2701/1932* (2013.01); *B65H 2301/323* (2013.01); *B65H 2301/33* (2013.01)
USPC ..... 270/1.02; 270/1.01; 198/644

(58) Field of Classification Search
USPC ..... 270/1.01, 1.02; 198/644; 493/444, 445; 271/227; 101/408
See application file for complete search history.

(56) References Cited

U.S. PATENT DOCUMENTS

| | | | | |
|---|---|---|---|---|
| 2,889,029 | A | 6/1959 | Ridenour | |
| 3,713,948 | A | 1/1973 | Kluger | |
| 3,891,492 | A | 6/1975 | Watson | |
| 3,915,785 | A | 10/1975 | Muller | |
| 4,201,617 | A | 5/1980 | Orsinger et al. | |
| 4,395,031 | A * | 7/1983 | Gruber et al. | 270/52.29 |
| 4,538,161 | A * | 8/1985 | Reist | 347/4 |
| 5,161,790 | A * | 11/1992 | March | 270/1.02 |
| 5,399,222 | A | 3/1995 | Reist | |
| 5,458,323 | A * | 10/1995 | Magee et al. | 270/52.02 |
| 5,596,932 | A * | 1/1997 | Honegger | 101/485 |
| 5,992,610 | A * | 11/1999 | Dufour et al. | 198/377.06 |
| 6,063,229 | A * | 5/2000 | Miles et al. | 156/277 |
| 6,264,192 | B1 * | 7/2001 | Siebenmann et al. | 271/205 |
| 6,585,102 | B2 | 7/2003 | Gammerler et al. | |
| 6,695,028 | B1 * | 2/2004 | Scheuber et al. | 156/387 |
| 6,974,128 | B2 * | 12/2005 | Quesnel | 271/227 |
| 7,854,426 | B2 * | 12/2010 | Honegger | 270/52.3 |
| 2004/0094892 | A1 * | 5/2004 | Kuramoto | 271/227 |
| 2006/0113165 | A1 | 6/2006 | Buechel | |
| 2007/0096378 | A1 * | 5/2007 | Honegger | 270/1.01 |
| 2008/0210521 | A1 | 9/2008 | Mueller | |

* cited by examiner

*Primary Examiner* — Patrick Mackey
(74) *Attorney, Agent, or Firm* — Lucas & Mercanti, LLP; Peter J. Phillips

(57) ABSTRACT

An apparatus and method for transporting flat products and for orienting such products for applying printed indicia while the products are transported, comprises a conveyor system which transports flat products in a first direction while holding the products in a first orientation generally orthogonal to the first direction, and, during transport, orients at least a peripheral portion of the product in a direction opposite the first direction, in an orientation and position for applying printed indicia on the peripheral portion of the product. The apparatus and method are particularly applicable for use in applying address information to the upper right corner of newspapers.

13 Claims, 14 Drawing Sheets

APPARATUS AND METHOD FOR ORIENTING PRODUCTS FOR APPLYING INDICIA DURING TRANSPORT

CROSS REFERENCE TO RELATED APPLICATIONS

This application claims priority on U.S. Ser. No. 61/171,159 filed Apr. 21, 2009, which is incorporated herein by reference.

BACKGROUND OF INVENTION

1. Field of the Invention

This invention relates to an apparatus and method for orienting products for applying indicia, such as printed indicia directly on the product or on a label, and more particularly to orienting flat paper products such as newspapers and magazines, as the products are transported, for applying printed indicia to the products directly or on a label.

2. Description of the Related Art

In product handling industries, machines are often employed to transport relatively flat product such as newspapers or other print media for various purposes. At some point in the transport process, it is desirable in some applications to apply printed indicia to the product, either directly or on a label which becomes affixed to the product. Such indicia may be address information for a subscriber, which typically contains the name and address of the subscriber, and/or a bar or other code encoding the address which can be read by scanners at the same or different facility.

presort zip code and sub-zip code order. However, because products when conveyed are usually transported in a tightly spaced relation, and may be totally or at least partially overlapping, it is difficult to apply the indicia in the same position and orientation on each product consistently. Attempts to apply the indicia often require slowing down the product stream and/or moving or repositioning the product in the stream.

When the product is in the form of newspapers or magazines, the printed indicia are usually in a particular location on the front cover page of the media, and have a certain orientation. The location may be dictated by postal regulation to get presort mail rates as mentioned above, and/or by a desire to locate the label to not obscure the space where other material appears on the front page, which space is a valuable commodity, especially for newspapers.

SUMMARY OF THE INVENTION

The present invention has particular application to newspapers and magazines or other flat, foldable product, which are transported in an orientation orthogonal to the direction of movement, are relatively closely-spaced, and have the same orientation in fully-overlapping arrangement, while still providing a consistent way to place indicia on the media in the same location accurately, without sacrificing speed.

The present invention has particular application to a media transport machine which has a conveyor which carries grippers at spaced intervals to grip and hold newspapers or magazines as they are transported in a vertical orientation with the front plane of the product orthogonal to the transport direction.

The present invention provides an apparatus for transporting foldable flat products, and for orienting such products for applying printed indicia while the products are transported, comprising a conveyor system which transports flat products in a first direction while holding the products in a flat orientation generally orthogonal to the first direction, and, during transport, folds a peripheral portion of the product in a direction opposite the first direction, in an orientation and position for applying printed indicia on the peripheral portion of the product.

The present invention provides an apparatus for transporting flat products and for orienting such products for applying printed indicia while the products are transported, comprising a conveyor system which transports flat products in a first direction while holding the products in a first orientation generally orthogonal to the first direction, and, during transport, rotates each product about an axis, which axis is generally parallel to the first direction, and folds a peripheral portion of the product in a direction opposite the first direction, in an orientation and position for applying printed indicia on the peripheral portion of the product.

The present invention provides a method for transporting foldable flat products and for orienting such products for applying printed indicia while the products are transported, comprising transporting flat products in a first direction while holding the products in a first orientation generally orthogonal to the first direction, and during the transporting, folding a peripheral portion of each product in a direction opposite the first direction, in an orientation and position for applying printed indicia on the folded peripheral portion of the product.

The present invention provides a method for transporting flat products and for orienting such products for applying printed indicia while the products are transported, comprising transporting flat products in a first direction while holding the products in a flat orientation generally orthogonal to the first direction, during the transporting, rotating each product about an axis, which axis is generally parallel to the first direction, and folding a peripheral portion of each product in a direction opposite the first direction, in an orientation and position for applying printed indicia on the folded peripheral portion of the product.

The present provides an apparatus for transporting flat products, and for orienting such products for applying printed indicia while the products are transported, comprising a conveyor system which transports flat products in a first direction while holding the products in a flat first orientation generally orthogonal to the first direction, and, during transport, orients at least a peripheral portion of the product in a second orientation parallel to the first direction, in a position for applying printed indicia on the peripheral portion of the product.

The present invention provides a method for transporting flat products and for orienting such products for applying printed indicia while the products are transported, comprising transporting products in a first direction while holding the products in a first orientation generally orthogonal to the first direction, and during the transporting, orienting at least a peripheral portion of the product in a second orientation parallel to the first direction, in a position for applying printed indicia on the peripheral portion of the product.

BRIEF DESCRIPTION OF THE DRAWINGS

The present invention may be more fully understood by reference to one or more of the following drawing figures, in which.

DETAILED DESCRIPTION OF A PREFERRED EMBODIMENT

The following is a description of a preferred embodiment of the invention. The present invention is not limited to the preferred embodiment, and is provided to enable one skilled in the art to make and use one exemplary form of the invention. The embodiment will be described using broadstreet newspapers as exemplary products, and wherein the printed indicia are in the form of names and addresses. However, it should be understood that the invention has particular application to any relatively flat, foldable products, such as other newspaper types, or magazines or other printed material.

In one form of the invention, newspapers will be transported in a normal orientation, then rotated, then folded, then aligned for printing. Newspapers of the broadstreet-type, when viewed in the normal orientation with the banner on top, have a folded edge at the bottom and an open edge on top. At the initial stage of transport, the newspaper is in the normal orientation. The newspaper will then be rotated, such that the open edge and headline will be oriented at the side. The rotation angle may be 90° or some other angle. The newspaper will then be folded at the peripheral edge along a creaseline such that the peripheral edge forms an angle of about 90° relative to the remainder of the newspaper. Of course, the angle may be greater than, or less than, 90°. In some cases, the rotation may not be needed or desired.

Figure 1:
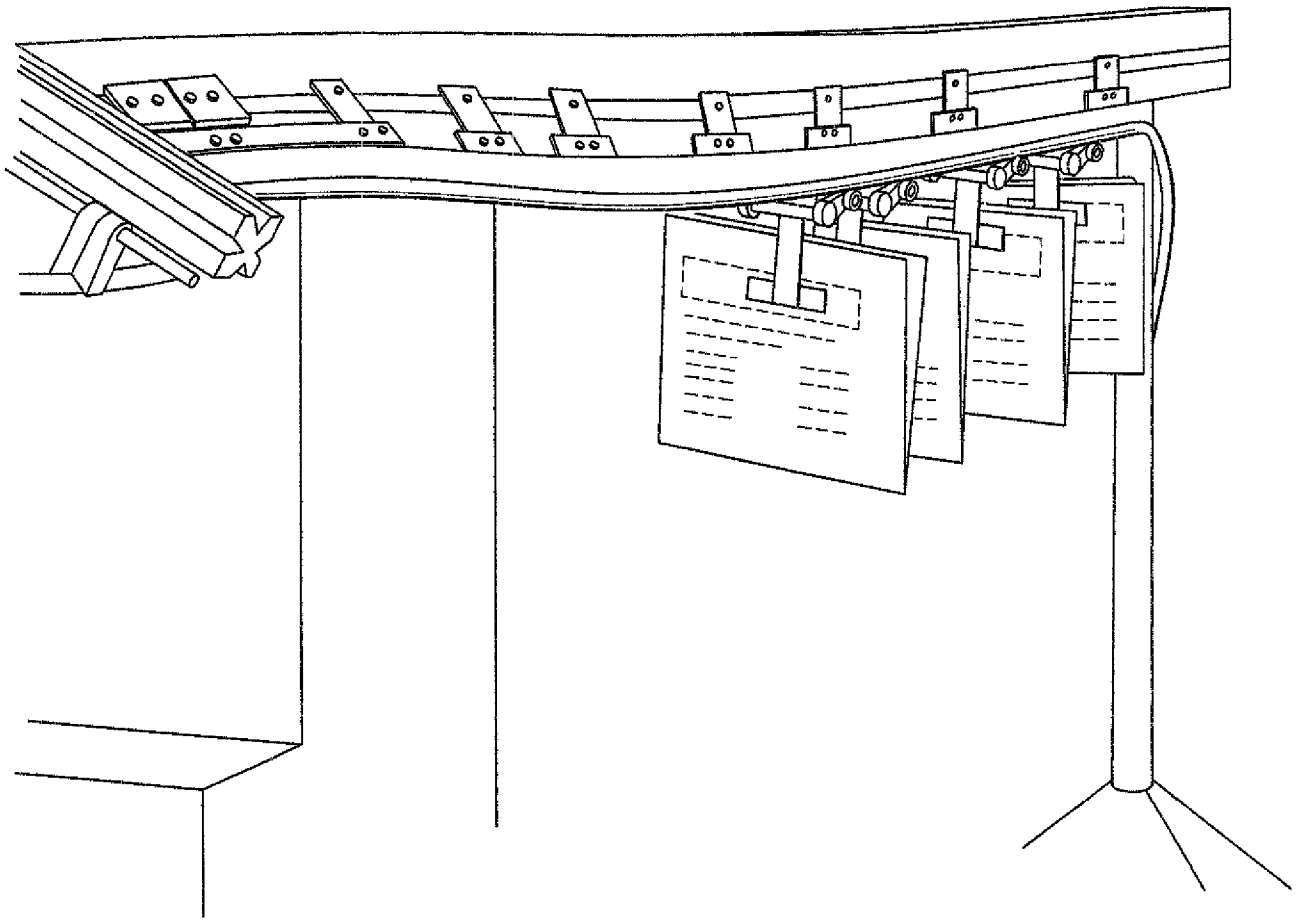
FIG. 1 is a perspective view of an apparatus according to one embodiment of the invention showing newspapers carried by a conveyor in a first or normal orientation.

For some presort mailing rates under U.S. Postal specifications, the address label on a newspaper should be in the upper-right corner of the newspaper, as shown in FIG. 1, where a box is shown to identify the location in which address information should be printed. Of course, an actual printed box need not be provided, and is shown merely for illustration purposes.

Figure 2:
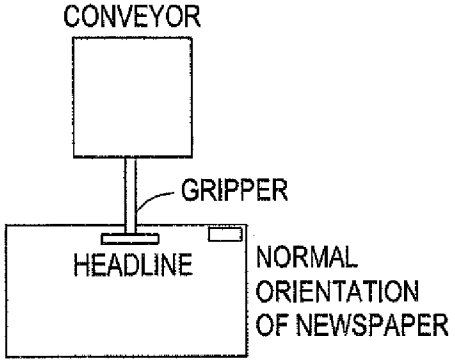
FIG. 2 is a plan view showing a newspaper in the first orientation, and being held by a gripper, and also showing a headline and preferred location where print information is to be applied.

FIG. 2 shows a conveyor being used for transporting or conveying the broadstreet newspapers. The conveyor comprises a chain or other mechanism to which is mounted a plurality of grippers for holding newspapers in the normal orientation, with the newspaper banner and open end on top and level, and with the fold at the bottom. The grippers are spaced from each other a certain distance, but are relatively close together.

The grippers are known in the art and comprise front and back clamp faces which are spring-loaded to frictionally engage and clamp a newspaper to hold it in place and keep it from slipping out from gravitational and other forces while the newspaper travels along the conveyor. Such grippers have an engagement mechanism to engage a bias force to clamp the faces closed, and a release mechanism to release the clamp faces and release the carried newspaper.

Figure 3:
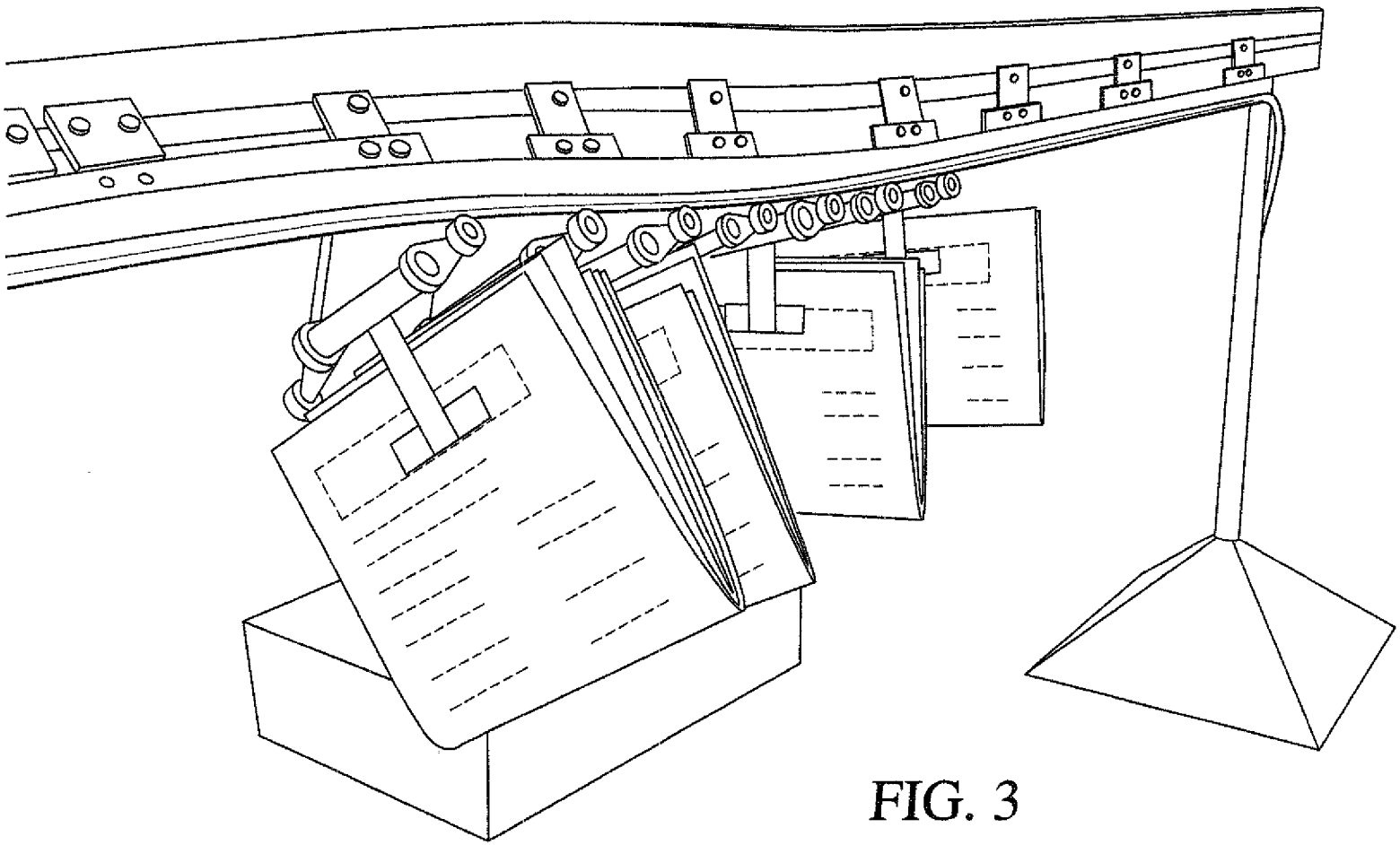
FIG. 3 is a perspective view of the same embodiment where in the newspapers are undergoing a rotated orientation from the first orientation of FIG. 1.

Initially the grippers hang vertically downward to provide the normal orientation for the newspapers. However, the tilt or rotation orientation of the gripper clamps may be changed, by tilting, rotating or twisting the conveyor structure in which the grippers are carried. The conveyor structure can be made of aluminum or some material which allows the structure to be twisted, but still provides sufficient rigidity and support. As shown in FIG. 3, the conveyor structure twists from the right-rear to the left-front, and the grippers follow that tilt or rotation angle and also twist. Such change in gripper orientation will rotate the newspaper from the normal orientation to raise the right-top corner and lower the left-top corner of the newspaper. The lead or front-most newspaper in FIG. 3 is shown rotated at about a 45° angle, relative to normal orientation of FIG. 2.

Figure 5:
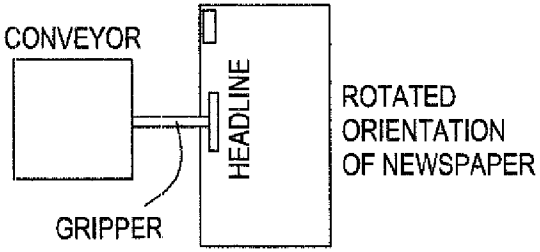
FIG. 5 is a plan view showing a second orientation of a newspaper, rotated about 90° from the first orientation.
Figure 4:
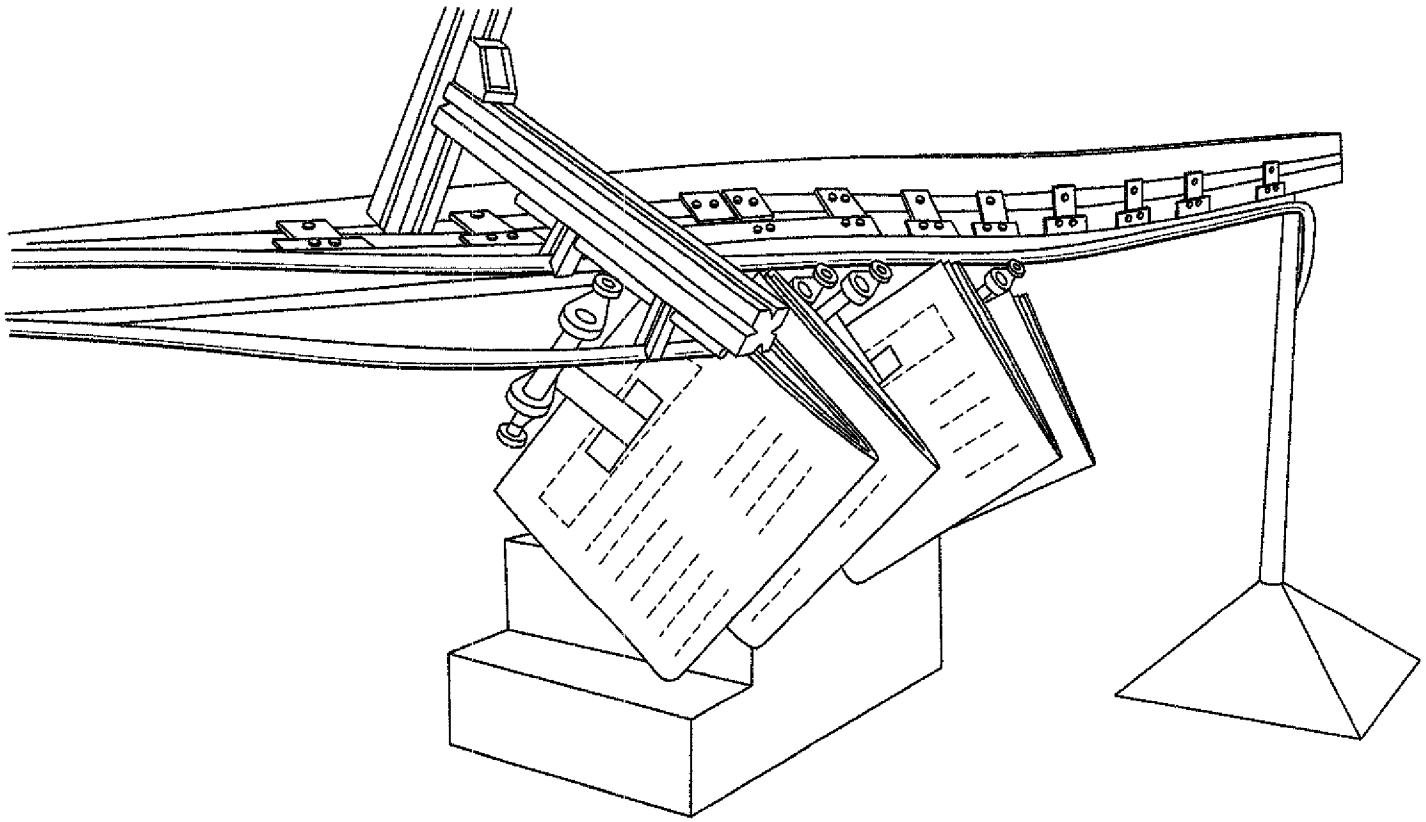
FIG. 4 is a perspective view of the same embodiment showing a further state of rotation of the orientation.

FIG. 4 shows the lead newspaper further along the conveyor with the rotation angle at about 60°. The rotation continues toward 90° as the conveyor twists from the right-rear to the left-front as shown in the FIG. 4. Eventually, the newspaper is fully-rotated 90° to achieve the position shown in FIG. 5, when viewing the front of the newspaper. This position may be referred to as the 90° rotation orientation.

Figure 6:
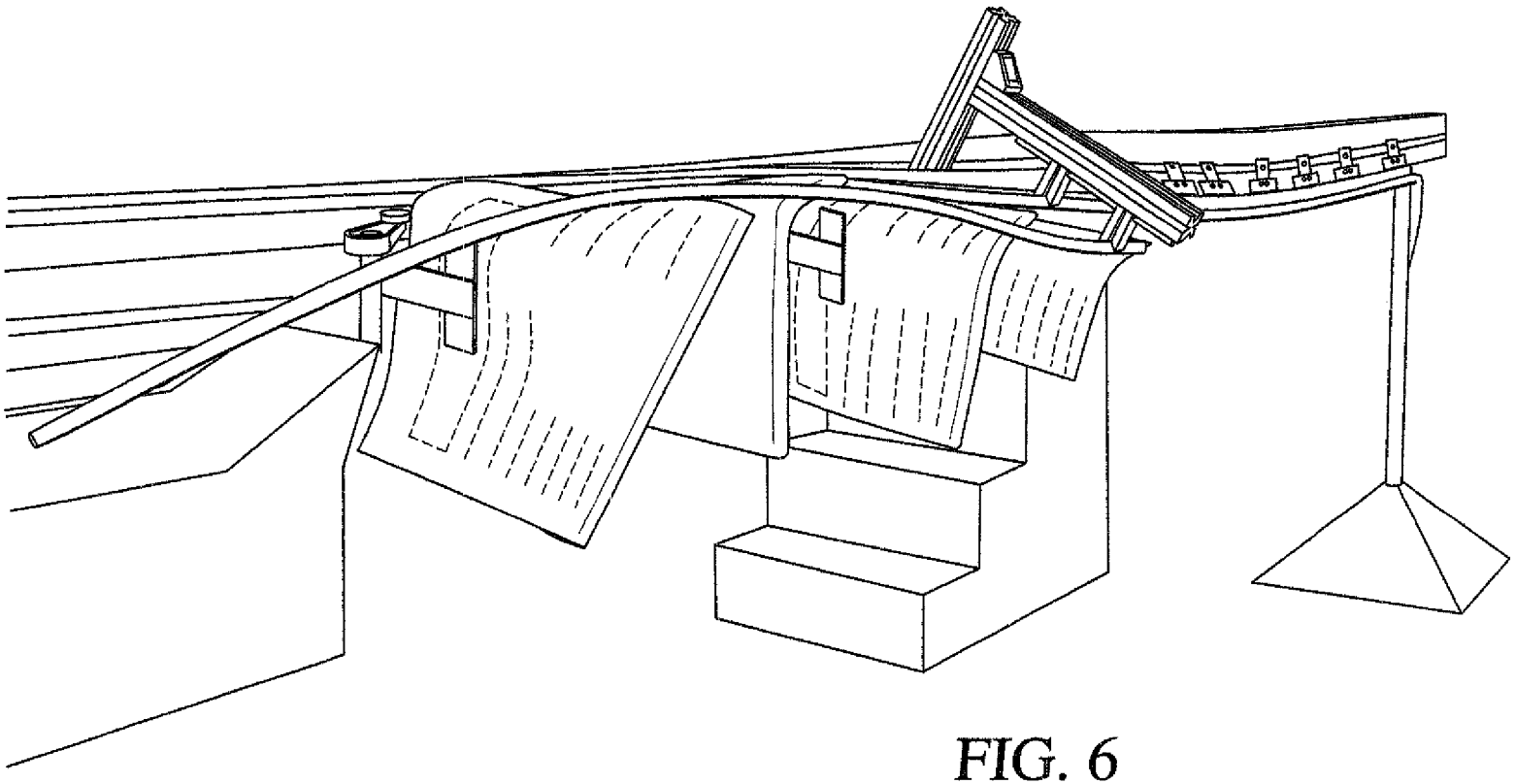
FIG. 6 is a perspective view of the same embodiment, showing newspapers undergoing a fold operation.
Figure 7:
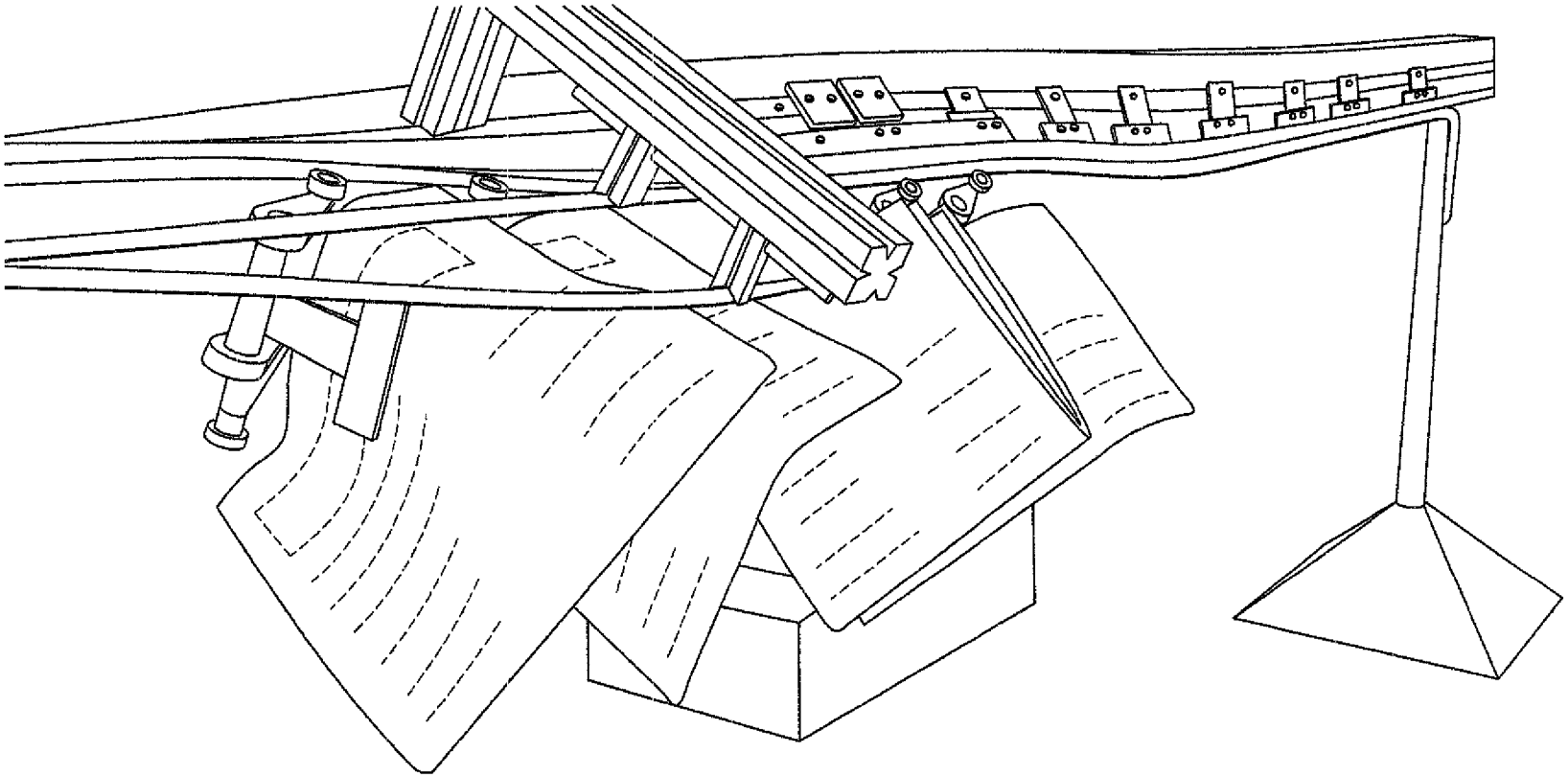
FIG. 7 is a perspective view of the same embodiment, showing newspapers further along in a fold operation.

As or after the newspaper is rotated to the 90° rotation orientation in the hold of the grippers, the right peripheral edge of the newspaper is urged by drag rails or folding bars, to fold the peripheral back on a fold or crease line such that the right peripheral edge is eventually at about 90° to the remaining unfolded part of the newspaper, as shown in FIG. 6. FIG. 7 shows two such drag rails or folding bars, but any number can be provided, and other structures could be used to perform the same function.

Figure 8:
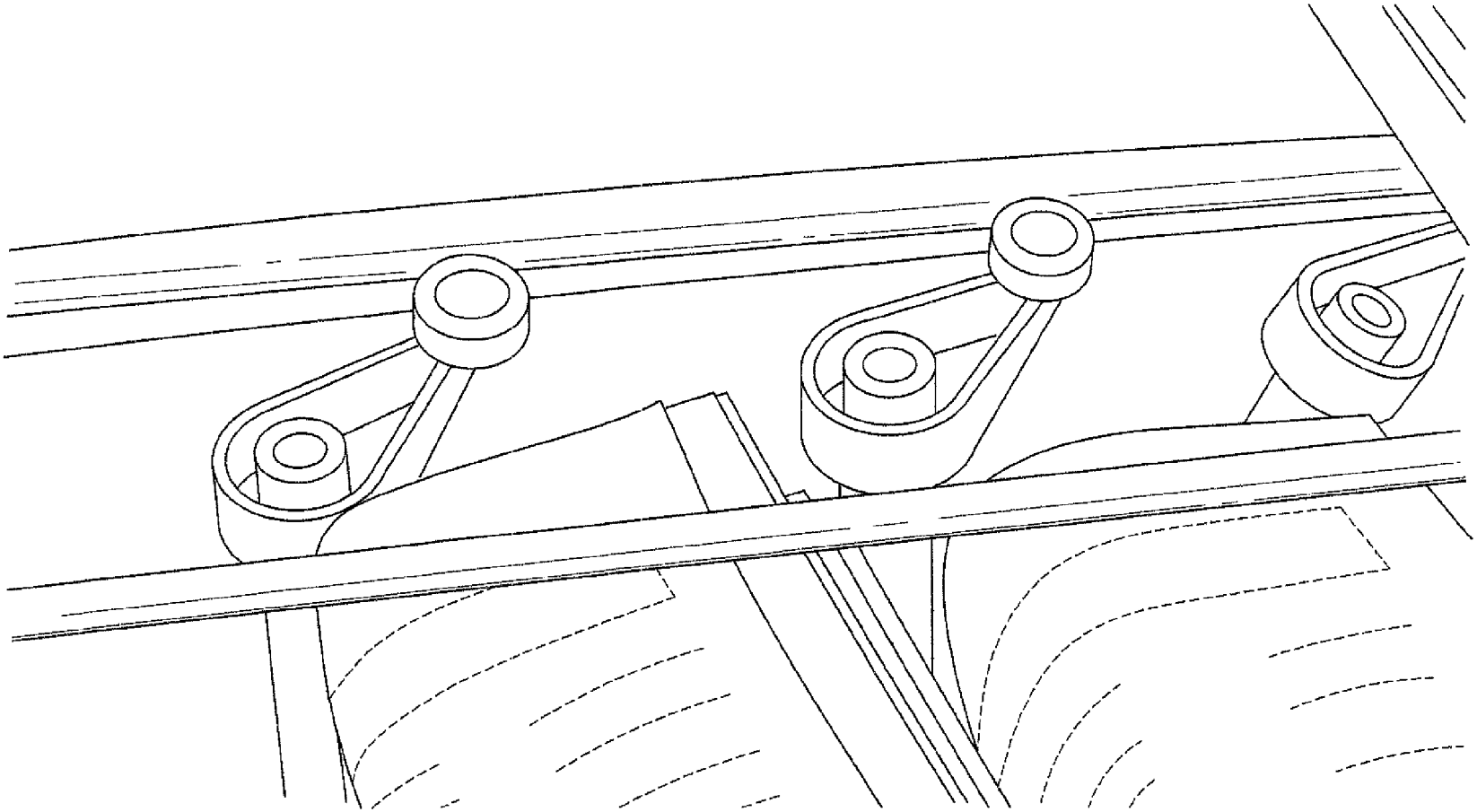
FIG. 8 is a closer view of the same embodiment, showing newspapers folded, but not entirely aligned.
Figure 9:
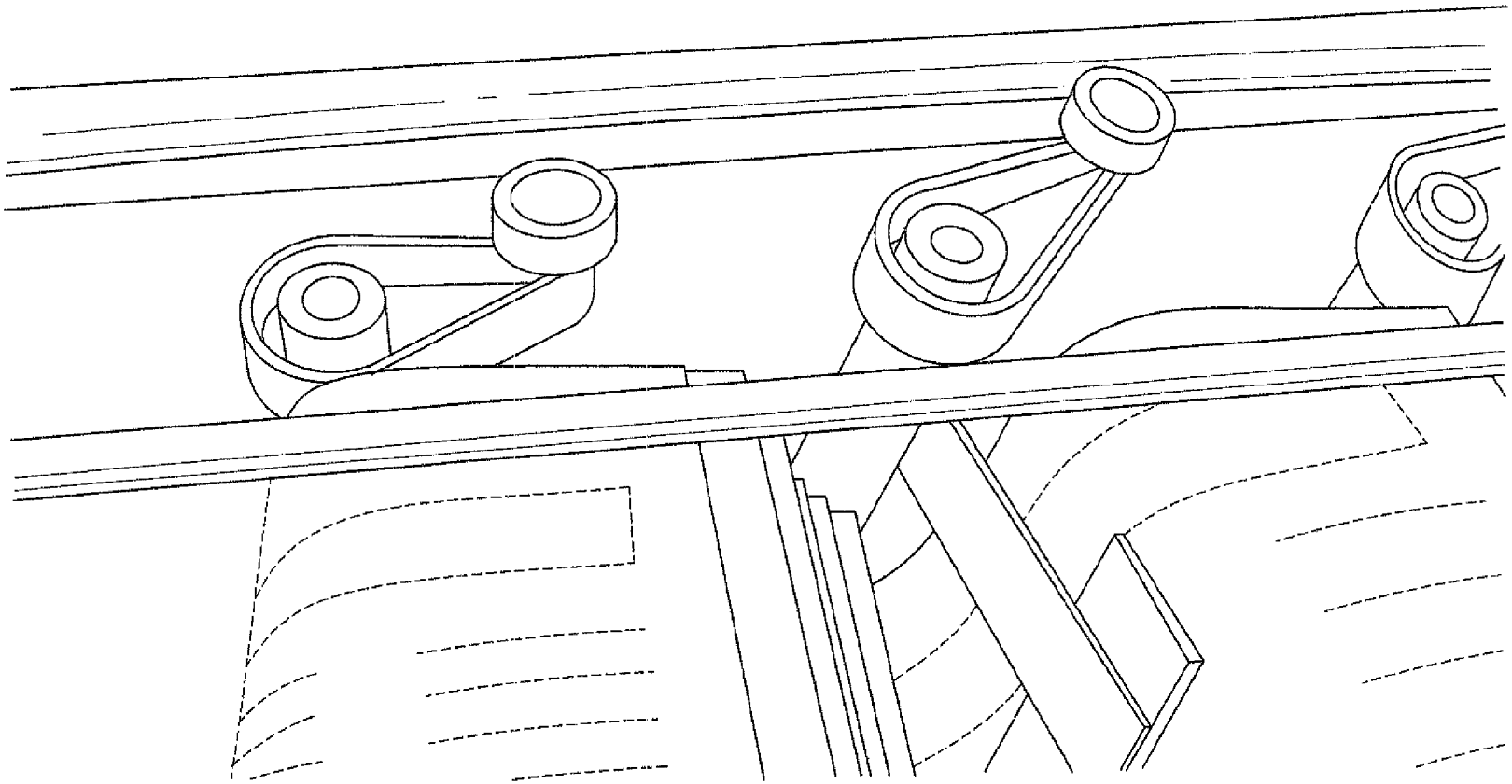
FIG. 9 is a view of the same embodiment, showing the newspapers fully aligned.

In this rotated and folded orientation, the right top corner of the newspaper could be provided with print address indicia by a printer or labeler. However, the stiffness of the newspaper typically results in having the top edge of the folded part of the newspaper misaligned as shown in FIG. 8. It is desired to have the top edge of the newspaper fully aligned with the direction of travel of the newspaper, optimal for applying indicia or a label square with the banner, as shown in FIG. 9. The preferred embodiment provides an articulation cam or rail to perform this alignment.

Figure 13:
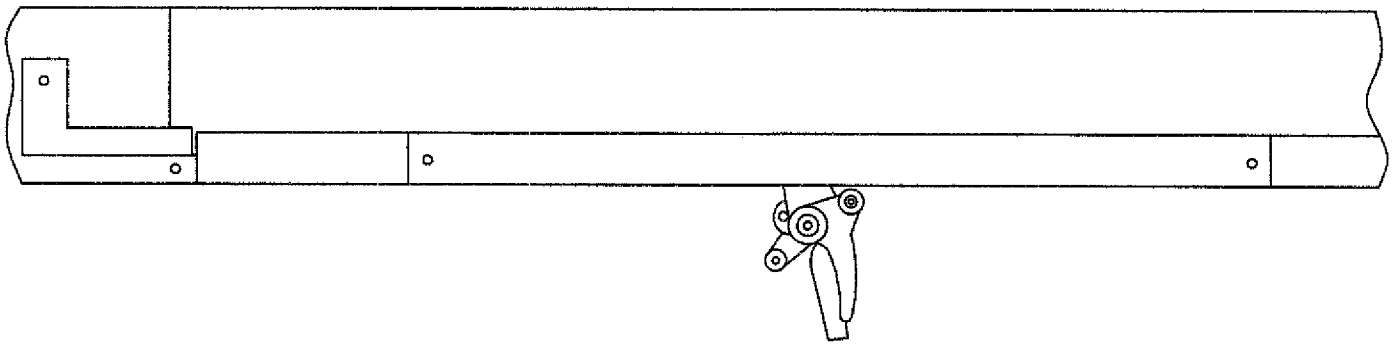
FIG. 13 shows an elevation view of an articulation cam relative to a gripper having a gripper roller which rides on the cam.
Figure 14:
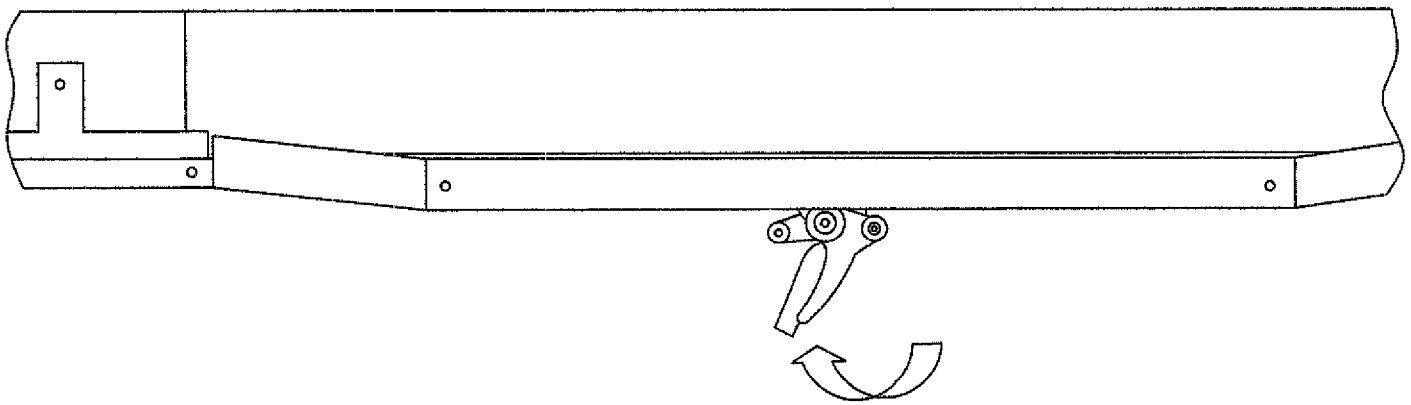
FIG. 14 shows the same as FIG. 13, but where the cam is positioned lower, to swing the gripper forward to effect alignment of a newspaper.

As shown in FIG. 13, an articulation cam provides a cam surface attached to the side of the conveyor structure against which a roller on the gripper will follow and roll. The gripper is spring biased to swing backward so that the roller on the gripper will be urged to be in contact the articulation cam. The position of the articulation cam surface relative to the conveyor structure which holds the grippers will determine the angle of swing of the grippers. Relative to the position shown in FIG. 13, as the cam is lowered as shown in FIG. 14, the gripper will be urged to swing forward, and the top corner of the newspaper will be lowered toward alignment in the direction of travel. The position of the articulation cam can be moved and adjusted relative to the conveyor until the top corner of the peripheral edge is in an aligned position, as shown in FIG. 9. This will result in having the newspaper top peripheral edge square and aligned with the direction of travel of the newspaper, as shown in FIG. 9, ready to receive print indicia.

Figure 12:
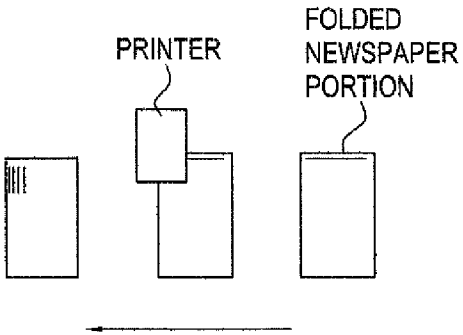
FIG. 12 shows an ink-jet printer which may be used to apply print indicia to the newspapers after they are folded and fully-aligned.
Figure 11:
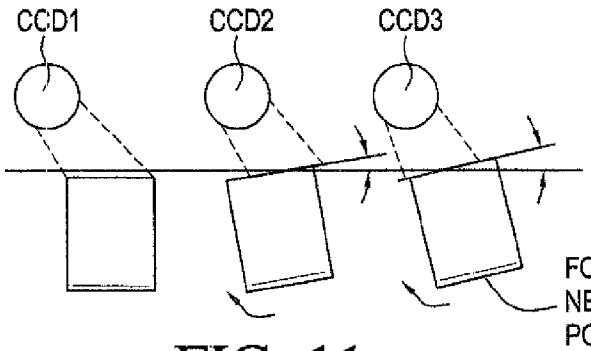
FIG. 11 shows CCDs located to capture alignment information.

As shown in FIG. 12, further along the conveyor system, a printer, such as an ink-jet printer, can be provided to print the subscriber name and address. The address can be printed directly on the newspaper, or can be printed on a label before or after attachment to the newspaper. Alternatively, a labeler could be used to provide aligned labels.

For pre-sort mailing rates, control of the printer or labeler to provide the subscriber address information typically provides the name and address of the subscribers in zip code order, and even by sub-zip codes, carrier routes, streets, and house numbers.

The articulation cam surface can, of course, be adjusted upwards, or downwards, to provide the proper alignment function to align the headline and print box in the direction of travel, so that the print indicia will be properly aligned to the banner and top and side edges of the newspaper to comply with postal regulations, or to locate the printing area to not interfere with other graphics on the newspaper, such as valuable advertising space, or even just for esthetic purposes.

Figure 10:
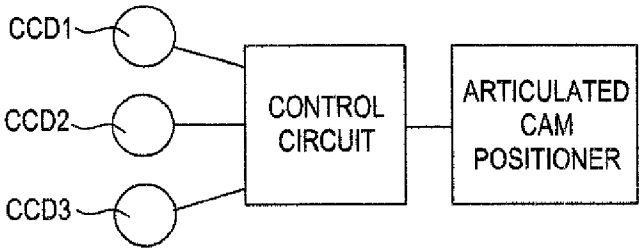
FIG. 10 is a block diagram showing a control system for performing the alignment of FIG. 9.

As shown in FIG. 10, an automatic adjustment arrangement may be provided, comprising a read device such as one or more CCD readers which capture the image of the top edge of the newspaper, feeds the input to a control circuit which detects the angle of tilt relative to the direction of transport or travel, calculates the amount of gripper arm swing needed to compensate for the angle of tilt and reduce it to zero, and then automatically moves the articulation cam to the proper position. The control system need not actually calculate or project the amount of gripper swing needed in advance, but may simply effect movement of the articulation cam until the angle of tilt of the paper is zero as detected by a CCD. Such an automatic adjustment feature would be particularly advantageous when newspapers or other products being transported and labeled vary in size, thickness, or stiffness, from run to run, or within runs, requiring frequent adjustment of the gripper swing angle to achieve proper alignment.

While the preferred embodiment has been described as including a twisted conveyor structure, it should be understood that the twisting can be optional, so that the newspaper is simply folded in the normal orientation without first being rotated. The articulation cam would still be arranged the same way, in relation to the conveyor structure, to provide the proper swing angle of the gripper to align the top edge of the peripheral folded portion of the newspaper with the direction of travel.

It should be also understood that for some applications the folding may be sufficient, without any alignment, particularly where the printer (or labeler) position is set to align the print lines with the designated printer area and banner. In that case, the printer can be set at the same angle as the top edge of the newspaper. The printer could be controlled by the same type of control system of FIG. 10, to adjust the rotation of the print head to print the indicia to be aligned with the newspaper.

FIGS. 15-18 show another arrangement for orienting products, wherein the products are first conveyed in the normal orientation, and are then rotated about an axis orthogonal to the transport direction. This arrangement is especially useful for newspapers or other products that are relatively thick or stiff, and are not easily foldable like that shown in FIG. 8.

Figure 15:
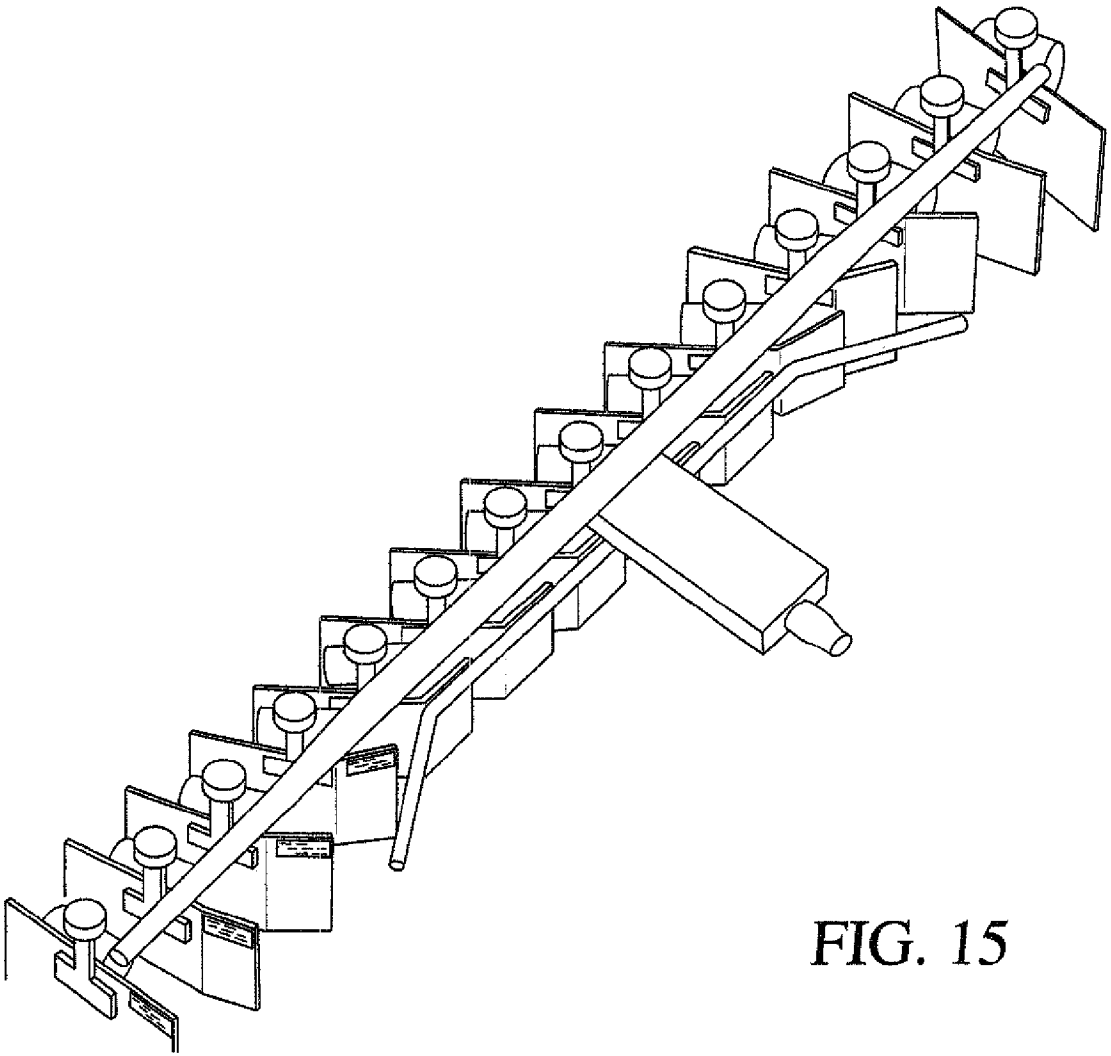
FIG. 15 is a perspective view of an arrangement for orienting newspapers for printing, by rotating the product about an axis orthogonal to the transport direction.
Figure 16:
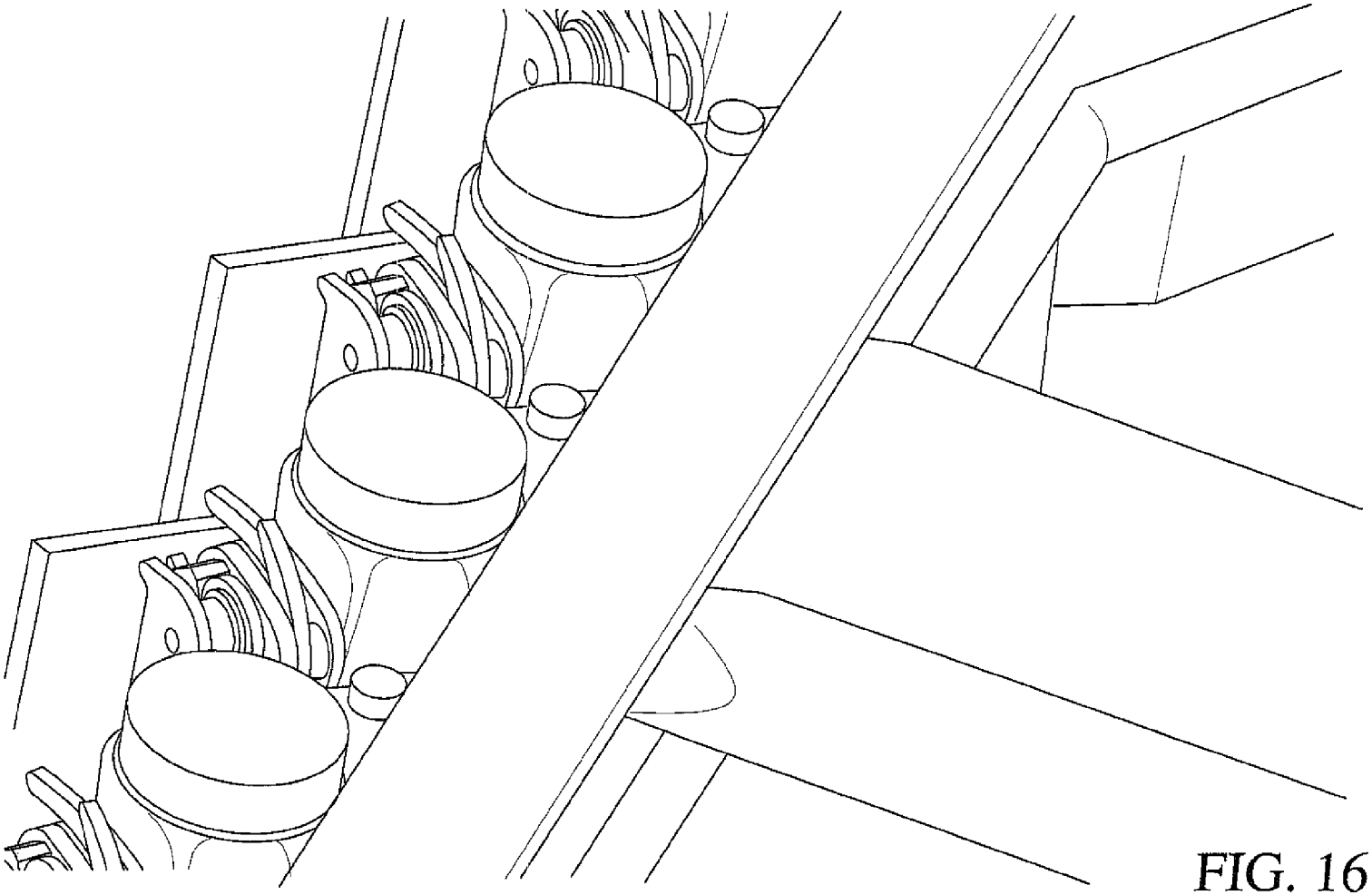
FIG. 16 is a perspective view of the same arrangement of FIG. 15, showing the cam arrangement for rotating the gripper.

FIG. 15 shows an example of a newspaper having a folded or splined side (at the bottom), and the spline is perpendicular or orthogonal to the direction of movement. The newspaper is then rotated about 45°. The peripheral edge of the newspaper is also partially folded by the paper-folding glide. The degree of fold is about 45°. As shown in FIG. 16, the rotation is accomplished by a gripper having a cam follow which follows a cam to rotate the gripper clamps holding the newspaper relative to the chain by which the gripper is conveyed. After the newspaper has print indicia applied, the cam surface gradually tapers away from the gripper conveyor so that the gripper returns the newspaper to the normal orientation. The paper-folding guide also tapers away to release the fold in the newspaper.

Figure 17:
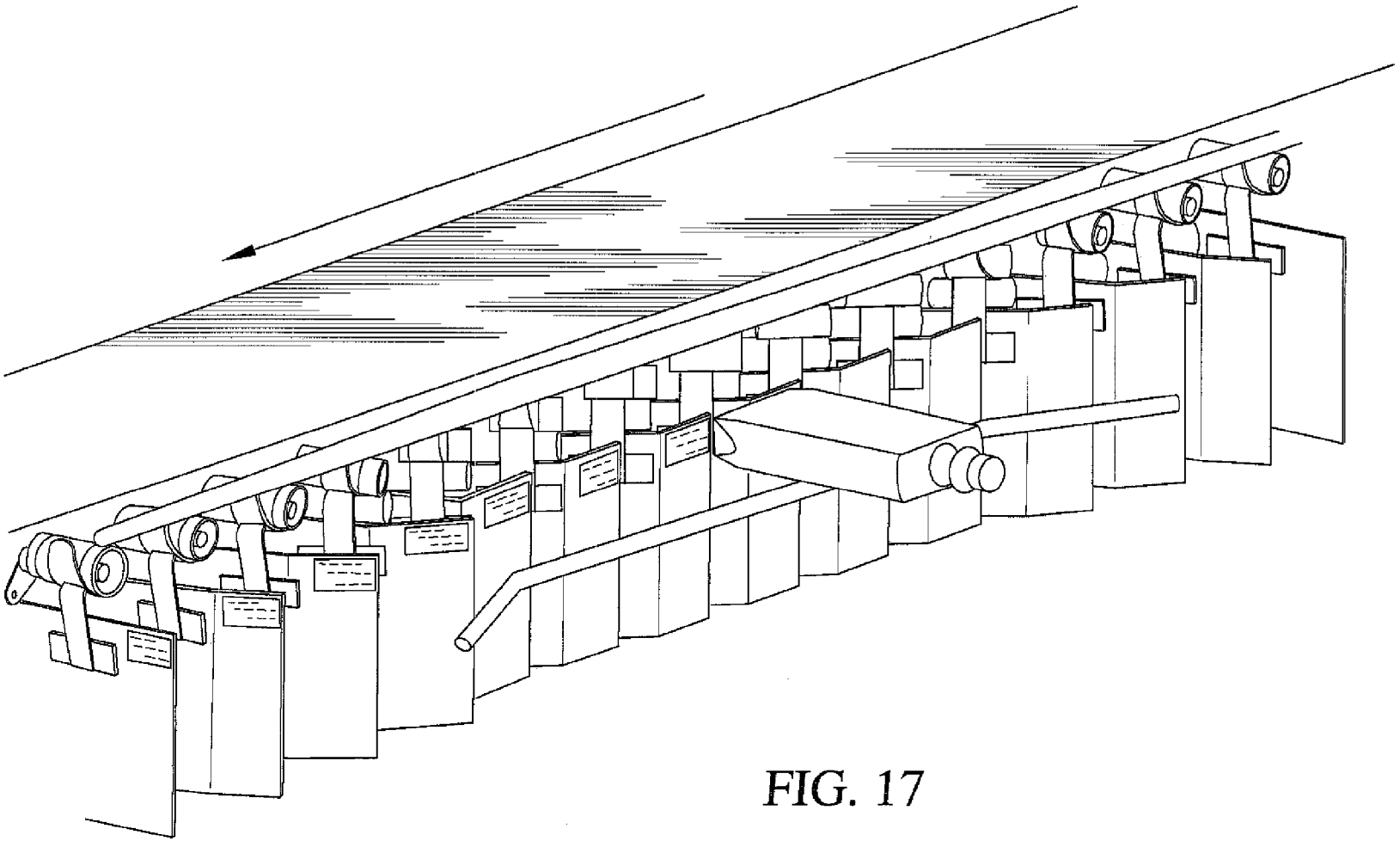
FIG. 17 is a perspective view of the same arrangement of FIG. 15, showing the printing applying printed indicia.
Figure 18:
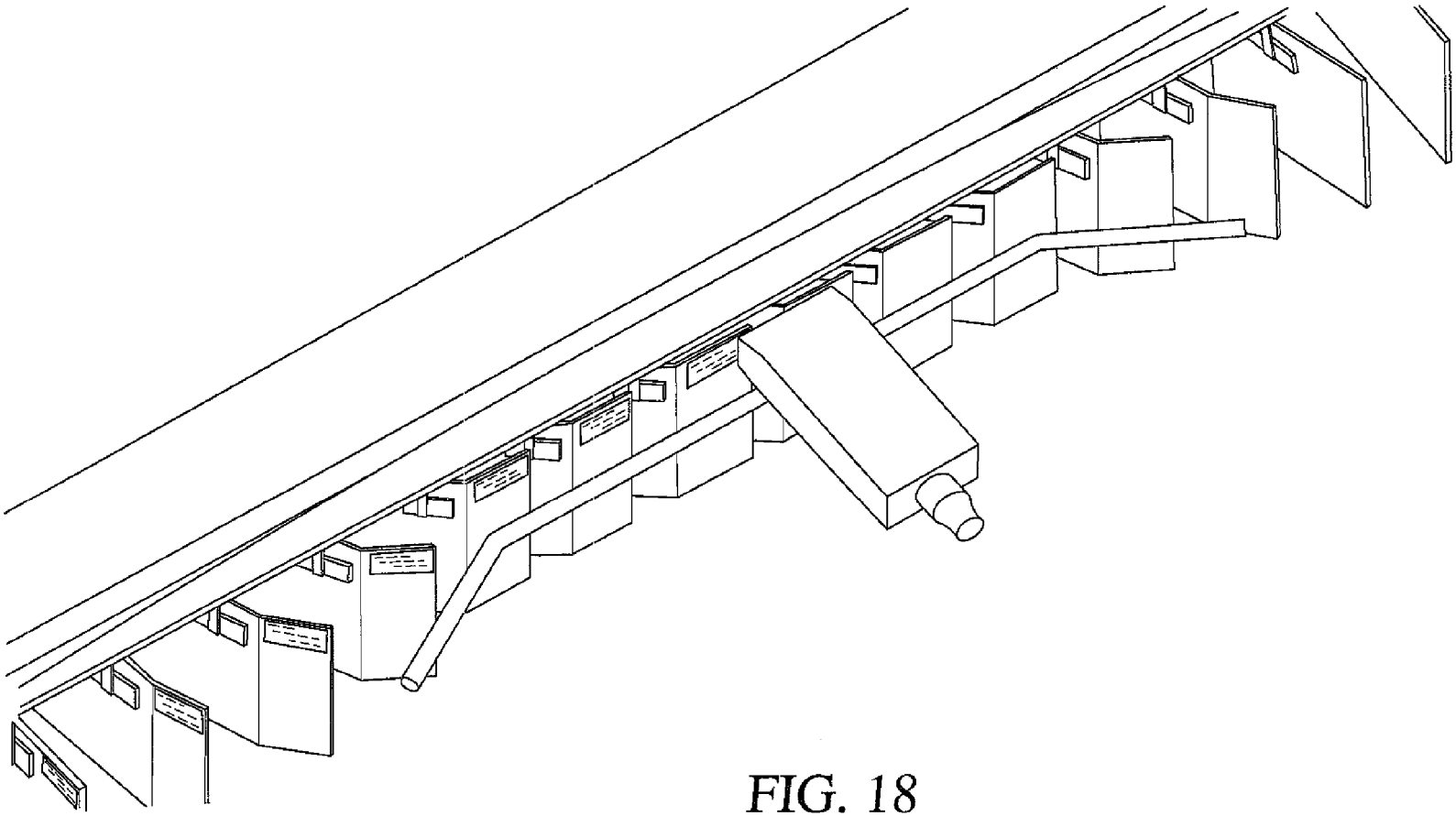
FIG. 18 is a perspective view of the same arrangement of FIG. 15, also showing the printer applying printed indicia.

FIG. 17 shows the arrangement of FIG. 15 from a different perspective, in which the print-head interaction with the folded newspapers is more clearly seen. FIG. 18 shows the arrangement from yet another perspective.

It should be understood that the rotation angle, as well as the fold angle, can be an angle other than about 45°. The total of the rotation angle and fold angle is preferably about 90°, but can be different than 90°.

While a preferred embodiment has been disclosed, the invention is not limited to the preferred embodiment, and variations may occur to those skilled in the art without departing from the scope of the invention. The scope is defined solely by way of the following claims.

The invention claimed is:

1. An apparatus for transporting flat products in a first direction and for orienting such products for applying printed indicia while the products are transported, comprising:

a folder, a printer and a conveyor system having a conveyor structure, which is twisted about an axis, wherein the axis is generally parallel to the first direction, wherein the conveyor system transports the flat products in the first direction while holding the products in a first orientation generally orthogonal to the first direction, and, during transport, rotates each product about said axis, and folds a peripheral portion of the product in a direction opposite the first direction, in an orientation and position for applying printed indicia on the peripheral portion of the product, wherein the conveyor system comprises a plurality of grippers to hold the products, and further including a cam surface along the conveyor system which swings the grippers forward about an axis, to align the peripheral portion of the product in the first direction, and further including a control system which determines whether the peripheral portion of the product is aligned in the first direction, and effects alignment of the product.

2. A method for transporting foldable flat products and for orienting such products for applying printed indicia while the products are transported, comprising:

transporting flat products in a first direction while holding the products in a first orientation generally orthogonal to the first direction, during the transporting, folding a peripheral portion of each product in a direction opposite the first direction, in an orientation and position for applying printed indicia on the folded peripheral portion of the product, and wherein the flat products are newspapers which have a fold edge, and an open edge opposite the fold edge, and wherein the step of transporting comprises holding each newspaper initially with the open edge oriented up, and then rotating each newspaper so that the open edge is oriented sideways.

3. The method of claim 2, further comprising the step of printing indicia on the folded peripheral portion of the product.

4. A method for transporting flat products and for orienting such products for applying printed indicia while the products are transported, comprising:

transporting flat products in a first direction while holding the products in a flat orientation generally orthogonal to the first direction, during the transporting, rotating each product about an axis, which axis is generally parallel to the first direction, folding a peripheral portion of each product in a direction opposite the first direction, in an orientation and position for applying printed indicia on the folded peripheral portion of the product, and wherein the flat products are newspapers which have a fold edge, and an open edge opposite the fold edge, and wherein the step of transporting comprises holding each newspaper initially with the open edge oriented up, and then rotating each newspaper so that the open edge is oriented sideways.

5. The method of claim 4, further comprising the step of printing indicia on the folded peripheral portion of the product.

6. A method for transporting flat products and for orienting such products for applying printed indicia while the products are transported, comprising:

transporting products in a first direction while holding the products in a first orientation generally orthogonal to the first direction, during the transporting, orienting at least a peripheral portion of the product in a second orientation parallel to the first direction, in a position for applying printed indicia on the peripheral portion of the product, and wherein the flat products are newspapers which have a fold edge, and an open edge opposite the fold edge, and wherein the step of transporting comprises holding each newspaper initially with the open edge oriented up, and then rotating each newspaper so that the open edge is oriented sideways.

7. The method of claim 6, wherein the step of orienting at least a peripheral portion of the product in a second orientation parallel to the first direction by a combination of rotating the product and folding a peripheral edge of the product.

8. The method of claim 6, further comprising the step of printing indicia on the peripheral portion of the product.

9. An apparatus for transporting flat products and for orienting such products for applying printed indicia while the products are transported, comprising:

a conveyor system which transports flat products in a first direction while holding the products in a first orientation generally orthogonal to the first direction, and, during transport, rotates each product about an axis, which axis is generally parallel to the first direction, and folds a peripheral portion of the product in a direction opposite the first direction, in an orientation and position for applying printed indicia on the peripheral portion of the product, wherein the conveyor system comprises a plurality of grippers to hold the products, and further including a cam surface along the conveyor system which swings the grippers forward about an axis, to align the peripheral portion of the product in the first direction, and wherein the apparatus further including a control system which determines whether the peripheral portion of the product is aligned in the first direction, and effects alignment of the product.

10. The apparatus of claim 9, wherein the flat products are newspapers having a fold edge and an open edge opposite to said fold edge, and wherein the conveyor system holds each newspaper initially with the open edge oriented up and then rotates the newspaper so that the open edge is oriented sideways.

11. The apparatus of claim 9, wherein the conveyor system comprises a plurality of grippers, each gripper adapted to hold a product generally along its top edge when the product is in the first orientation.

12. The apparatus of claim 9, further comprising a printer device which supplies printed indicia on the peripheral portion after the product is folded.

13. The apparatus of claim 9, wherein the conveyor system comprises a conveyor body having a plurality of grippers to hold the products, and wherein the body of the conveyor twists and rotates in the first direction, and thereby rotates the orientation of grippers to rotate each product.

* * * * *